US010497485B2

(12) United States Patent
Graves et al.

(10) Patent No.: US 10,497,485 B2
(45) Date of Patent: Dec. 3, 2019

(54) SYSTEMS AND METHODS FOR FORMULATING RADIOACTIVE LIQUIDS

(71) Applicant: Curium US LLC, St. Louis, MO (US)

(72) Inventors: Kevin B. Graves, Catawissa, MO (US); Bryan S. Petrofsky, St. Louis, MO (US); Sumit Verma, Chesterfield, MO (US); John Schmitz, St. Charles, MO (US); Greg Bushman, Florissant, MO (US); Jesse Gurley, IV, Belleville, IL (US); Paul Hibbeln, Richmond Heights, MO (US)

(73) Assignee: Curium US LLC, St. Louis, MO (US)

( * ) Notice: Subject to any disclaimer, the term of this patent is extended or adjusted under 35 U.S.C. 154(b) by 230 days.

(21) Appl. No.: 15/368,265

(22) Filed: Dec. 2, 2016

(65) Prior Publication Data

US 2018/0158563 A1 Jun. 7, 2018

(51) Int. Cl.

| | |
|---|---|
| ***A61J 1/10*** | (2006.01) |
| ***A61J 1/14*** | (2006.01) |
| ***G21F 5/00*** | (2006.01) |
| ***G21K 5/00*** | (2006.01) |
| ***B65D 43/02*** | (2006.01) |

(Continued)

(52) U.S. Cl.

CPC ..... *G21K 5/00* (2013.01); *A61J 1/10* (2013.01); *A61J 1/1475* (2013.01); *B65D 43/02* (2013.01); *B65D 83/00* (2013.01); *B65D 85/82* (2013.01); *G21F 5/00* (2013.01)

(58) Field of Classification Search

CPC ..... G21K 5/00; G21F 5/00; A61J 1/10; A61J 1/1475; B65D 43/02; B65D 83/00; B65D 85/82

USPC ..... 250/492.1, 493.1, 496.1, 428, 430, 435, 250/436

See application file for complete search history.

(56) References Cited

U.S. PATENT DOCUMENTS

| | | | |
|---|---|---|---|
| 3,576,998 | A | 5/1971 | Deutsch et al. |
| 3,657,541 | A | 4/1972 | Deutsch et al. |
| 3,857,485 | A | 12/1974 | Frank |

(Continued)

FOREIGN PATENT DOCUMENTS

| | | | |
|---|---|---|---|
| EP | 0068605 | A2 | 1/1983 |
| EP | 0118217 | A2 | 9/1984 |

(Continued)

OTHER PUBLICATIONS

International Search Report and Written Opinion of the International Searching Authority regarding PCT/US2016/069194 dated Nov. 10, 2017; pp. 1-17.

*Primary Examiner* — Nicole M Ippolito
*Assistant Examiner* — Hanway Chang
(74) *Attorney, Agent, or Firm* — Armstrong Teasdale LLP

(57) ABSTRACT

Systems and methods for formulating a radioactive liquid using a disposable container are described. The disposable container includes a flexible sidewall defining an interior space for containing the radioactive liquid during formulation. The flexible sidewall is constructed of sterile, pyrogen-free material to prevent contamination of the radioactive liquid. The flexible sidewall includes a first portion and a second portion. The disposable container also includes an access port and a dispense port. The access port is defined by the first portion of the flexible sidewall to provide access to the interior space. The dispense port is defined by the second portion of the flexible sidewall for the radioactive liquid within the interior space to be dispensed through.

20 Claims, 9 Drawing Sheets

(51) Int. Cl.
*B65D 83/00* (2006.01)
*B65D 85/82* (2006.01)

(56) References Cited

U.S. PATENT DOCUMENTS

| | | | |
|---|---|---|---|
| 4,282,863 | A | 8/1981 | Beigler et al. |
| 4,472,299 | A | 9/1984 | Weisner et al. |
| 4,783,305 | A | 11/1988 | Forrest |
| 5,196,001 | A | 3/1993 | Kao |
| 6,157,036 | A | 12/2000 | Whiting et al. |
| 2006/0048841 | A1 | 3/2006 | Luehrsen et al. |

FOREIGN PATENT DOCUMENTS

| | | | |
|---|---|---|---|
| EP | 1874671 | A | 1/2008 |
| WO | 0033322 | A1 | 6/2000 |
| WO | 2007114800 | A2 | 10/2007 |

SYSTEMS AND METHODS FOR FORMULATING RADIOACTIVE LIQUIDS

FIELD

The field of the disclosure relates generally to formulating radioactive materials and, more particularly, to systems and methods for formulating radioactive liquids using disposable containers.

BACKGROUND

Radioactive material is used in nuclear medicine for diagnostic and therapeutic purposes by injecting a patient with a small dose of the radioactive material, which concentrates in certain organs or regions of the patient. Radioactive materials typically used for nuclear medicine include Germanium-68 ("Ge-68"), Strontium-87m, Technetium-99m ("Tc-99m"), Indium-111m ("In-111"), Iodine-131 ("I-131") and Thallium-201. Sometimes, the radioactive materials are generated from another radioactive material, such as Molybdenum-99 (Mo-99).

Prior to use, the radioactive materials may be formulated from a raw, concentrated form into a form having a desired concentration. For example, radioactive liquids may be homogeneously mixed, pH-adjusted, sampled, diluted, and dispensed. Sometimes, the radioactive liquids are contained within a reusable glass vessel during formulation. After formulation, the vessels are washed to remove radioactive residue and then placed in long-term radiologically shielded storage. After the vessels have been stored for a time sufficient to allow any radioactive material to decay, the vessels may be cleaned, sterilized, and reused. Accordingly, these vessels can be expensive to produce and use. As a result, the cost to formulate radioactive materials is increased. Also, processing the vessels for reuse generates radioactive waste, such as rinse fluids used to remove radioactive materials from the vessels. In addition, personnel may be exposed to radiation when handling the vessels during and after formulation.

Accordingly, a need exists for an inexpensive formulation container that does not require long-term radiologically-shielded storage, and reduces operator exposure to radiation.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF SUMMARY

In one aspect, a disposable container for use in formulating a radioactive liquid includes a flexible sidewall defining an interior space for containing the radioactive liquid during formulation. The flexible sidewall is constructed of sterile, pyrogen-free material to prevent contamination of the radioactive liquid. The flexible sidewall includes a first portion and a second portion. The disposable container also includes an access port and a dispense port. The access port is defined by the first portion of the flexible sidewall to provide access to the interior space. The dispense port is defined by the second portion of the flexible sidewall for the radioactive liquid within the interior space to be dispensed through.

In another aspect, a system for formulating a radioactive liquid includes a nuclear radiation containment chamber including an enclosure constructed of a nuclear radiation shielding material. The system also includes a disposable container and a positioning device positioned within the interior of the enclosure. The disposable container includes a flexible sidewall defining an interior space for containing the radioactive liquid during formulation. The positioning device includes a support configured to support the disposable container on the positioning device and an actuator operatively connected to the support and configured to rotate the support. A dispense pump is connected to the disposable container in fluid communication with the interior space to dispense the radioactive liquid from the interior space.

In yet another aspect, a method of formulating radioactive liquid contained within a disposable container includes connecting the disposable container to a positioning device and rotating an actuator of the positioning device to position the disposable container in a first position. The method also includes formulating the radioactive liquid within the interior space while the disposable container is in the first position. The method further includes rotating the actuator of the positioning device to position the disposable container in a second position and dispensing the liquid from the disposable container using a dispense pump. The radioactive liquid is directed towards a dispense port of the disposable container when the disposable container is in the second position.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the several views of the drawings.

DETAILED DESCRIPTION

Example systems and methods of the present disclosure provide disposable containers for use in formulating radioactive liquids. Accordingly, embodiments reduce exposure of personnel to radiation and reduce the resources required to formulate radioactive liquids. In particular, embodiments eliminate the requirement to clean and store reusable vessels that may be contaminated with radioactive materials. In addition, some embodiments provide a positioning device that positions the disposable containers during formulation of the radioactive liquids within the disposable container.

As used herein, the terms "formulate", "formulation", and "formulating" refer to combining materials to form a material having a desired concentration and pH.

Figure 1:
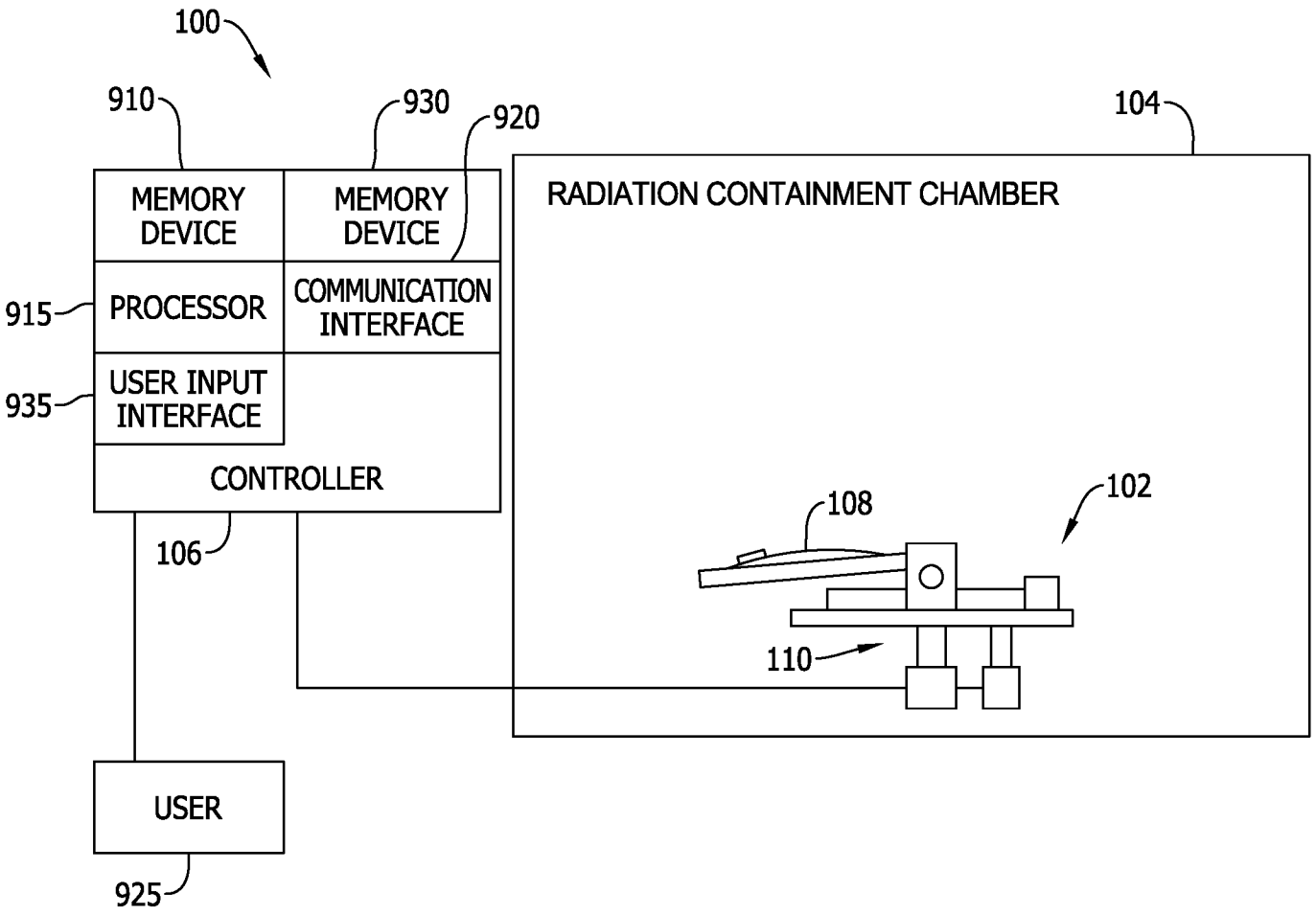
FIG. 1 is a schematic view of a system for formulating radioactive materials.

FIG. 1 is a schematic view of a system for handling liquids, indicated generally by reference numeral 100. Although the system 100 is described herein with reference to formulating radioactive liquids, the system is not limited to formulating radioactive liquids and may be used for handling other materials. The system 100 generally includes a formulation apparatus 102 enclosed within the interior of a shielded nuclear radiation containment chamber 104, also referred to herein as a "hot cell", and a human-machine interface (HMI) (generally, a computing device or controller 106) connected to the formulation apparatus 102 by a suitable communication link (e.g., a wired connection). The formulation apparatus 102 and the controller 106 may be connected to a suitable power supply. Suitable power supplies include, for example and without limitation, a 120V AC power supply or a 480V AC 3-phase power supply. As described further below, the formulation apparatus 102 is configured to formulate radioactive liquids within a disposable container 108.

The formulation apparatus 102 is enclosed within the containment chamber 104 to shield operators and radiation-sensitive electronics of the controller 106 from nuclear radiation emitted by radioactive materials within the containment chamber 104. The containment chamber 104 generally includes an enclosure 108 constructed of nuclear radiation shielding material designed to shield the surrounding environment from nuclear radiation. The enclosure defines an interior in which the formulation apparatus 102 is positioned. Suitable shielding materials from which the containment chamber 104 may be constructed include, for example and without limitation, lead, depleted uranium, and tungsten. In some embodiments, the containment chamber 104 is constructed of steel-clad lead walls forming a cuboid or rectangular prism. Further, in some embodiments, the containment chamber 104 may include a viewing window constructed of a transparent shielding material. Suitable materials from which viewing windows may be constructed include, for example and without limitation, lead glass.

Figure 2:
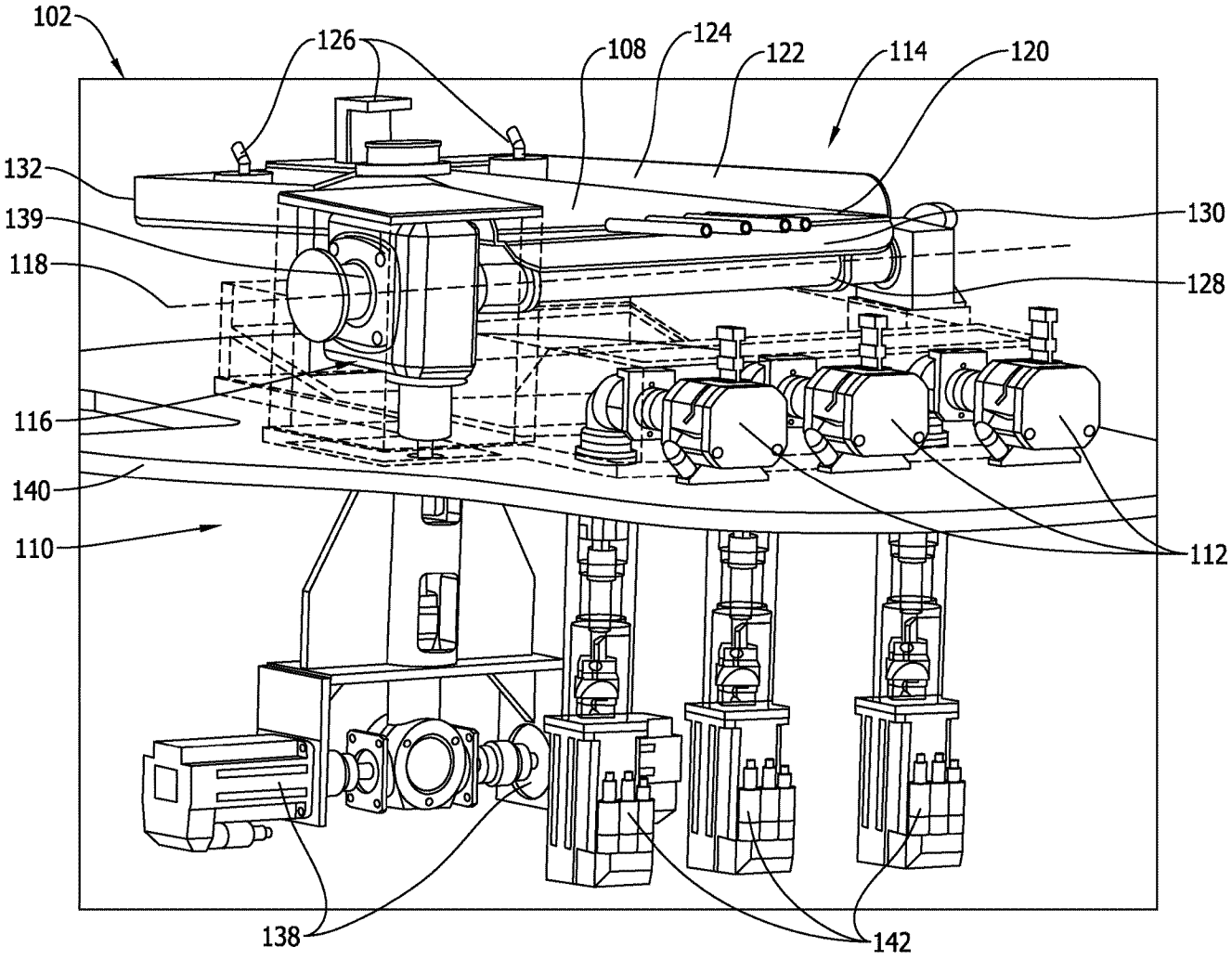
FIG. 2 is a perspective view of a formulation apparatus of the system shown in FIG. 1.
Figure 3:
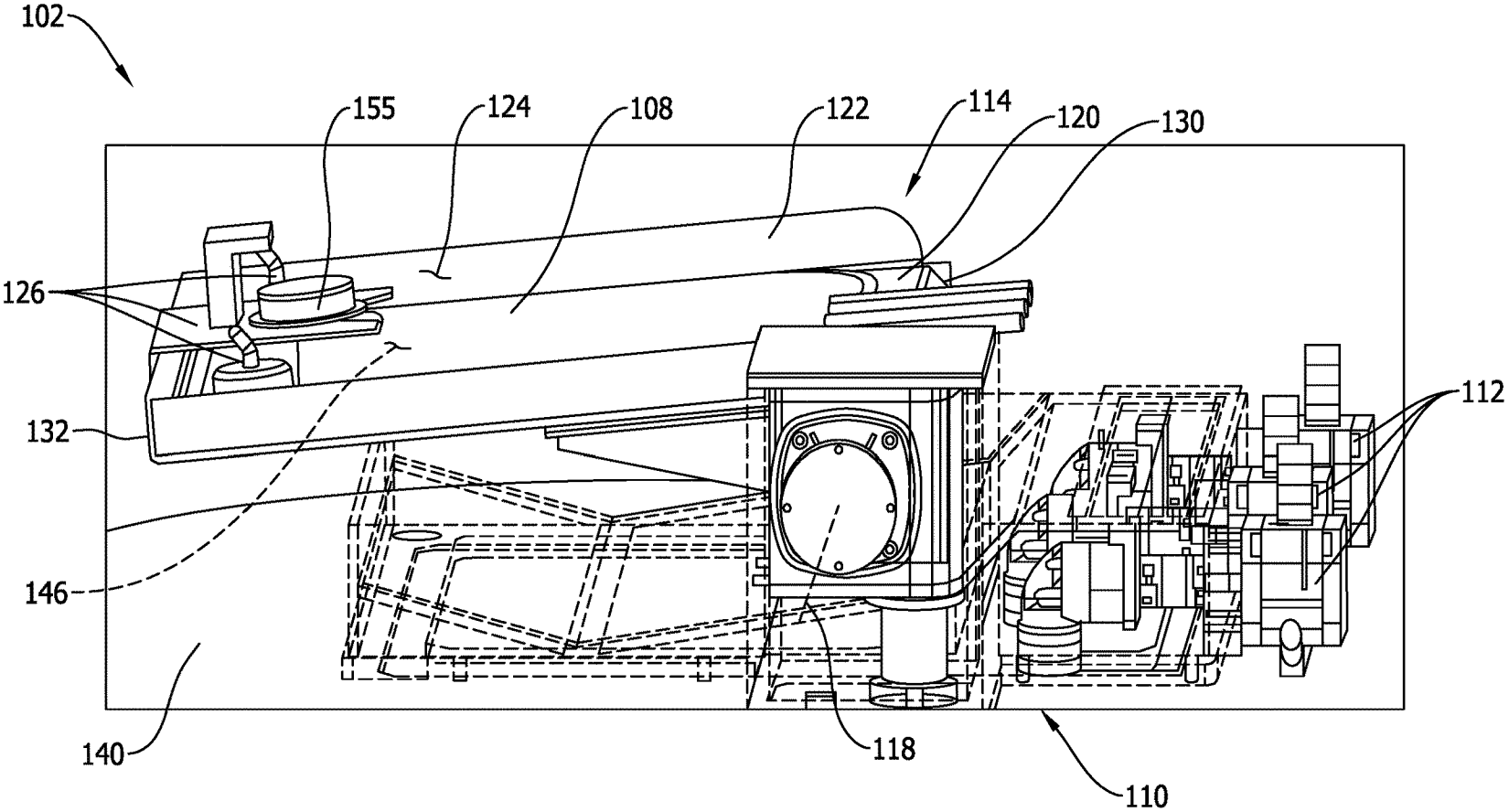
FIG. 3 is an enlarged view of a portion of the formulation apparatus shown in FIG. 2.

FIG. 2 is a perspective view of the formulation apparatus 102. FIG. 3 is an enlarged view of a portion of the formulation apparatus 102. The formulation apparatus 102 generally includes a positioning device 110 and at least one pump 112. The formulation apparatus 102 is configured to perform at least one operation on radioactive liquids within the disposable container 108. For example, the formulation apparatus 102 may be configured to perform operations including, without limitation, extracting a sample of the liquid, testing the liquid, adjusting a pH of the liquid, homogeneously mixing the liquid, diluting the liquid, and dispensing the liquid.

During formulation, raw material may undergo a series of operations or processes before the material reaches a target state. For example, in some embodiments, raw radioactive material (e.g., Mo-99) is quality control tested, chemically treated if necessary, and pH adjusted prior to diluting the raw radioactive material to a desired final target concentration. The raw radioactive material may be diluted to the final target concentration by combining the raw radioactive material with another liquid, such as water for injection (WFI). After the raw radioactive material has been diluted, the formulated liquid may be dispensed to a suitable containment vessel for storage. In some embodiments, all formulation tasks may be performed at a single station, i.e., a formulation station. In further embodiments, at least one of the described tasks may be performed at a separate station.

The positioning device 110 is configured to support the disposable container 108 during formulation of radioactive liquids within the disposable container 108. The positioning device 110 includes a table, broadly a support, 114 and an actuator 116 operatively connected to the table 114 for positioning the table 114. As will be described in more detail below, the actuator 116 is configured to rotate the table 114 about a rotation axis 118 to position the disposable container 108 during formulation.

In this embodiment, the table 114 includes a plate 120 and a sidewall 122 extending from and partially circumscribing the plate 120. The plate 120 and the sidewall 122 define a cavity 124 configured to receive the disposable container 108. A plurality of connectors 126 are positioned within the cavity 124 to secure the disposable container 108 to the table 114. The connectors 126 include at least one hook and an engagement member. In other embodiments, the disposable container 108 may be positioned on the table 114 and supported in any manner that enables the formulation apparatus 102 to operate as described. For example, in some embodiments, the plate 120 and the sidewall 122 are omitted and the disposable container 108 is secured to one or more arms. In other embodiments, the disposable container 108 is connected to the positioning device 110 using any suitable connector including, for example and without limitation, fasteners, straps, hooks, clamps, adhesives, and cords.

In the illustrated embodiment, the actuator 116 is operatively connected to the table 114 by a rotatable shaft 128. The table 114 has a first end 130 connected to the rotatable shaft 128 and a second end 132 positioned distal from the rotatable shaft 128. Accordingly, the table 114 pivots or rotates about the rotation axis 118 when the rotatable shaft 128 is rotated. In other embodiments, the table 114 may rotate about any axis. For example, in some embodiments, the rotatable shaft 128 is connected to the table 114 intermediate the first end 130 and the second end 132 and the table 114 rotates about an axis intermediate the first end 130 and the second end 132.

Figure 4:
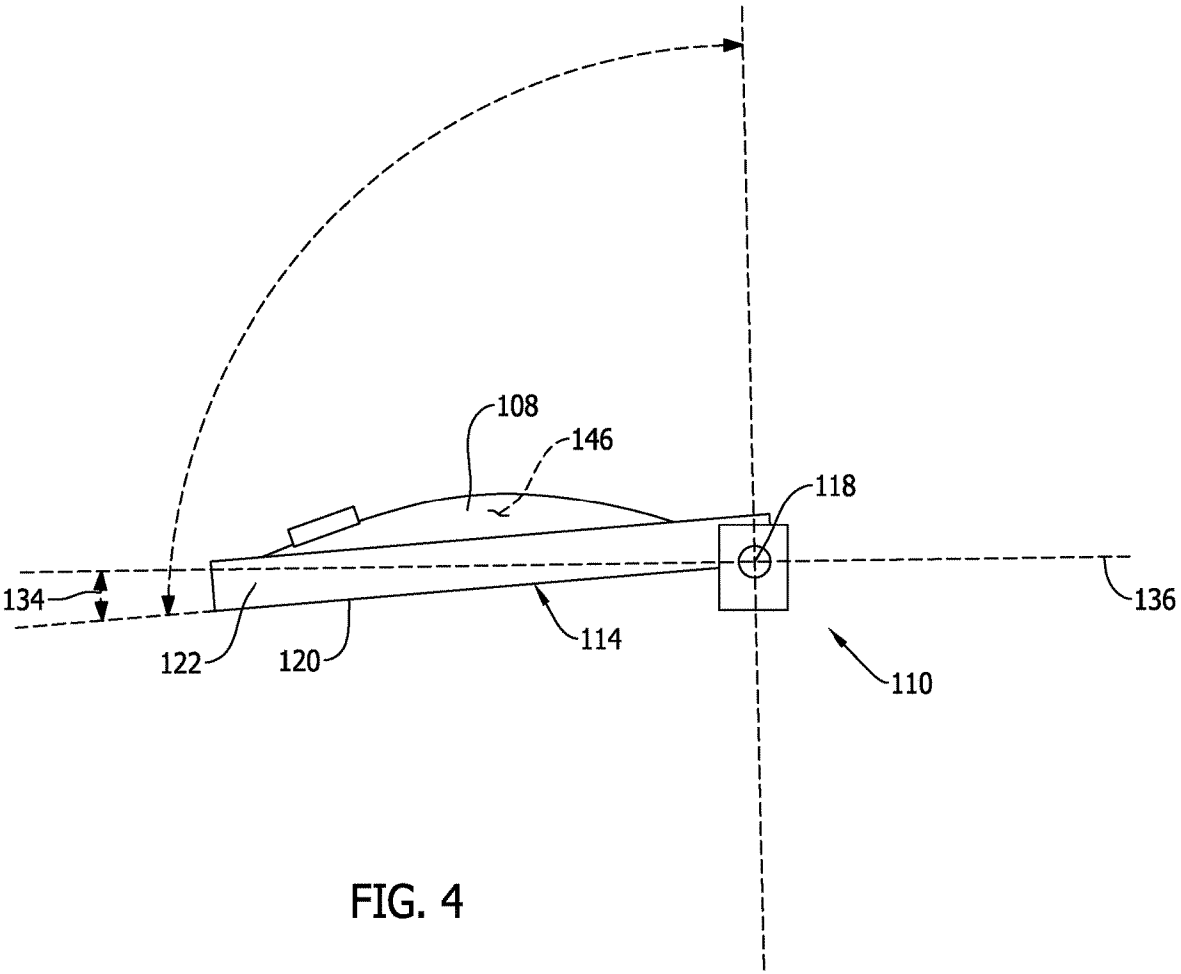
FIG. 4 is a schematic view of a positionable table of the formulation apparatus shown in FIG. 2.

In reference to FIG. 4, the actuator 116 is configured to rotate the rotatable shaft 128, and, thereby, the table 114, about the rotation axis 118. In particular, the table 114 may be rotated such that the plate 120 of the table 114 is positioned at an angle 134 relative to a horizontal plane 136. For example, the angle 134 may be in a range of about −5° to about 90°. In other embodiments, the table 114 may be positioned at any angle that enables the formulation apparatus 102 to operate as described.

In reference to FIG. 2, the actuator 116 includes at least one motor 138 and a drive mechanism 139 connecting the motor 138 to the rotatable shaft 128. In the illustrated embodiment, the actuator 116 includes at least one redundant motor 138 to reduce downtime of the formulating apparatus 102 if one of the motors 138 is inoperable. The motors 138 are connected to the controller 106 (shown in FIG. 1) and receive signals from the controller 106. The motors 138 may include resolvers or the like to provide real-time position feedback. In other embodiments, the actuator 116 may include any motor that enables the formulation apparatus 102 to operate as described.

In the illustrated embodiment, the drive mechanism 139 suitably includes a miter gearbox that is operatively connected to the motor and the rotatable shaft to rotate the rotatable shaft 128 during operation of the motors 138. In other embodiments, the actuator 116 may include any drive mechanism that enables the positioning device 110 to operate as described.

In addition, the formulation apparatus 102 of this embodiment includes three pumps 112. Specifically, the formulation apparatus 102 includes a dispense pump 112, a circulation pump 112, and a redundant pump 112. As will be described in more detail below, the dispense pump 112 is configured to pump liquids out of the disposable container 108. The circulation pump 112 is configured to circulate liquids contained in the disposable container 108. The redundant pump 112 may be configured to perform the functions of the circulation pump 112 and the dispense pump 112. Accordingly, the redundant pump 112 may be put in service to reduce down time of the formulation apparatus 102 if one of pumps 112 is inoperable. In the illustrated embodiment, each of the pumps 112 is a peristaltic pump. In other embodiments, the formulation apparatus 102 may include any pump that enables the formulation apparatus 102 to operate as described.

Each of the pumps 112 is operatively connected to, or driven by, a motor 142 positioned beneath the clean work surface 140. The motors 142 are configured to drive the pumps 112 such that the pumps 112 direct liquid flow through tubing connected to the pumps 112. The motors 142 are suitably connected to the controller 106 (shown in FIG. 1) to receive signals from the controller. In other embodiments, the pumps 112 may be controlled in any manner that enables the formulation apparatus 102 to operate as described.

The formulation apparatus 102 is configured to prevent contamination of the radioactive liquid during formulation. For example, in the illustrated embodiment, the motors 138, 142 are positioned below a clean work surface 140 to inhibit contamination of the work area. In other embodiments, any component of the system 100 (shown in FIG. 1) may be positioned below the clean work surface 140 or on the exterior of the radiation containment chamber 104 (shown in FIG. 1) to prevent contamination to the radioactive liquid and/or reduce exposure to radiation.

Figure 5:
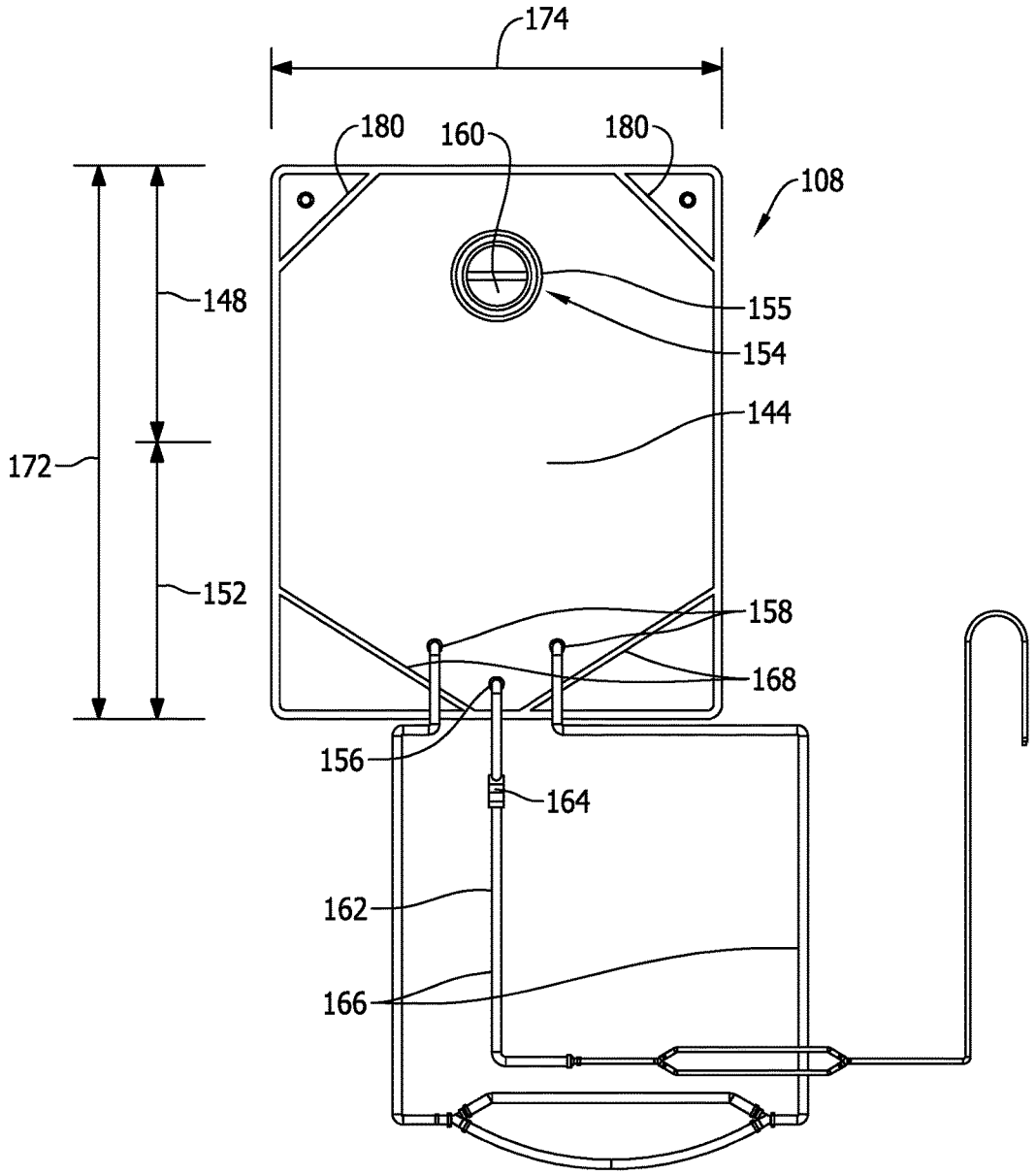
FIG. 5 is a front view of a disposable container for use with the formulation apparatus shown in FIG. 3.

FIG. 5 is a front view of a disposable container 108 for use with the formulation apparatus 102 (shown in FIG. 2). The disposable container 108 includes a flexible sidewall 144 defining an interior space 146 for containing material, such as radioactive liquids. In the illustrated embodiment, the flexible sidewall 144 includes two rectangular, plastic sheets sealed along lateral edges 186 and longitudinal edges 190 to form a rectangular bag structure.

In other embodiments, the disposable container may be constructed in other ways. For example, in an alternative embodiment, the disposable container may include one or more ports disposed in the seams of the bags, e.g., three ports welded into a bottom seam of the bag. In another embodiment, one or more tubes extends through the seam into the bag. In other embodiments, a port flange may be attached to a seam and have an oval shape. In still other embodiments, rather than separate components welded to the disposable container, the bottom seam includes tubing welded directly thereto, similar to an intravenous (IV) fluid bag. Generally, the ports may be formed in any manner that enables the disposable container to function as described.

The disposable container is suitably sterile, pyrogen free, and compatible with radioactive materials, such as Molybdenum-99 (Mo-99), Germanium-68 ("Ge-68"), Strontium-87m, Technetium-99m ("Tc-99m"), Indium-111m ("In-111"), Iodine-131 ("I-131") and Thallium-201. For example, the disposable container 108 may be made of materials including, without limitation, linear low-density polyethylene (LLDPE), ethylene vinyl acetate (EVA), polypropylene, nylon, polychlorotrifluoroethene (PCTFE), and fluorinated ethylene propylene (FEP). In other embodiments, the disposable container 108 may be made of other materials in any suitable manner.

The disposable container 108 may be disposed of after use because the disposable container 108 is inexpensive to replace. Accordingly, cleaning and/or long term shielded storage of the disposable container 108 may not be necessary. In addition, the disposable container 108 does not require cleaning validation which is required for reusable pharmaceutical vessels. As a result, the time and resources required to handle the disposable container 108 may be reduced. In addition, radioactive waste, such as rinse liquids, may be reduced. Also, the disposable container 108 is not prone to shattering, which may occur with other vessels such as glass vessels.

In reference to FIG. 5, the disposable container 108 defines a length 172 and a width 174. For example, in the illustrated embodiment, the disposable container has a length of about 29 inches and a width 174 of about 23 inches. In other embodiments, the disposable container 108 may be any size that enables the disposable container 108 to function as described. For example, in some embodiments, the disposable container 108 may have a length 172 in a range of about 12 inches to about 48 inches and a width 174 in a range of about 12 inches to about 48 inches.

The disposable container 108 includes a first portion 148, a second portion 152, and at least one opening or port. In the illustrated embodiment, the disposable container 108 includes an access port 154, a dispense port 156, and circulation ports 158. The access port 154 is positioned in the first portion 148. The dispense port 156 and the circulation ports 158 are positioned in the second portion 152. In other embodiments, the disposable container 108 may include any port or opening that enables the disposable container 108 to function as described.

The disposable container 108 is sized to hold a predetermined volume within interior space 146. In some embodiments, the disposable container 108 has a volume of approximately 50 liters. The volume of the disposable container 108 may be limited by seams, ports, and other features of the disposable container 108. In this embodiment, the disposable container 108 may contain between about 0.5 liters and about 25 liters of the radioactive liquid. In other embodiments, the disposable container 108 may have any volume that enables the disposable container 108 to function as described.

Figure 6:
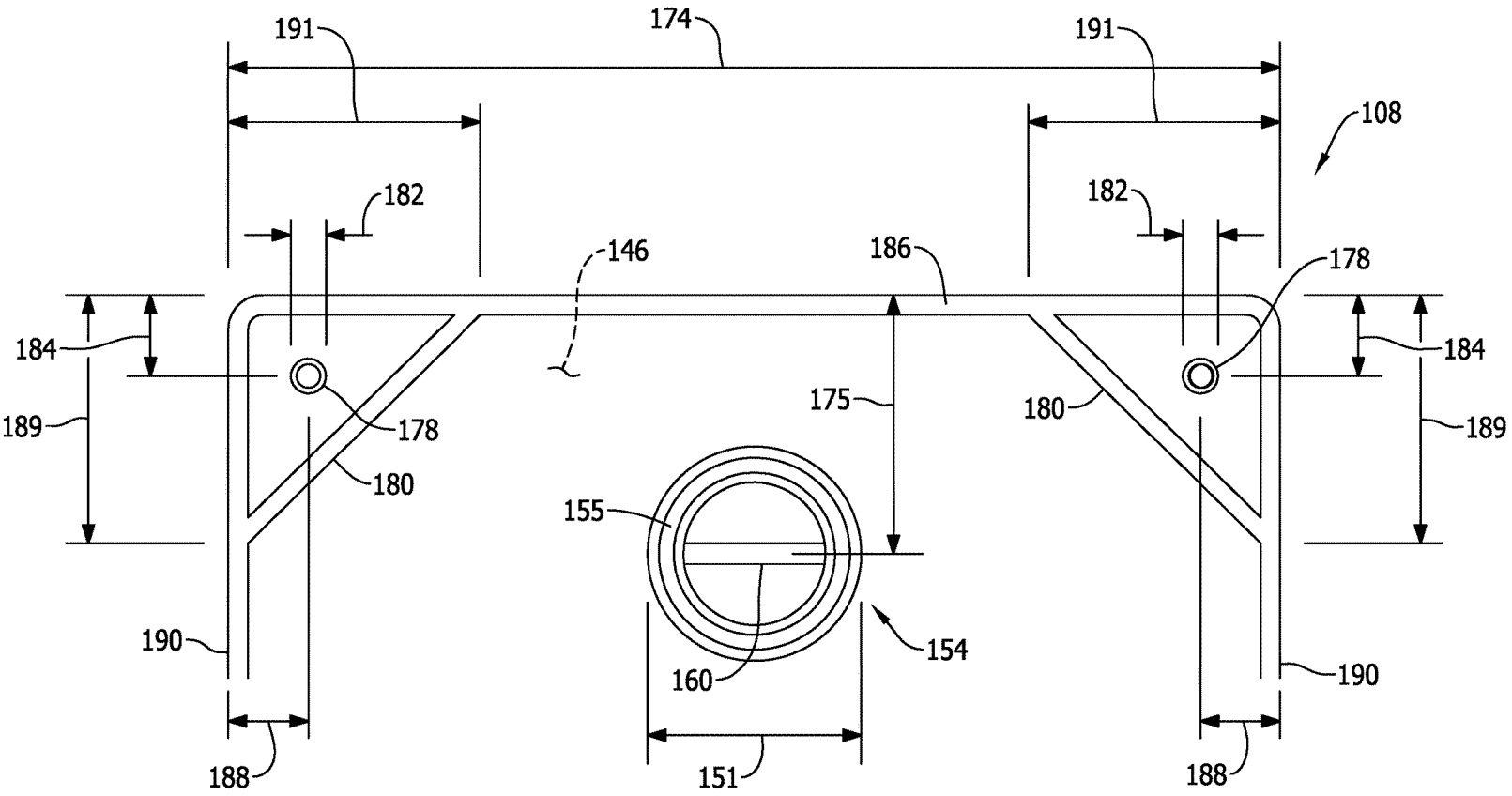
FIG. 6 is an enlarged view of a portion of the disposable container shown in FIG. 5 including an access port.
Figure 7:
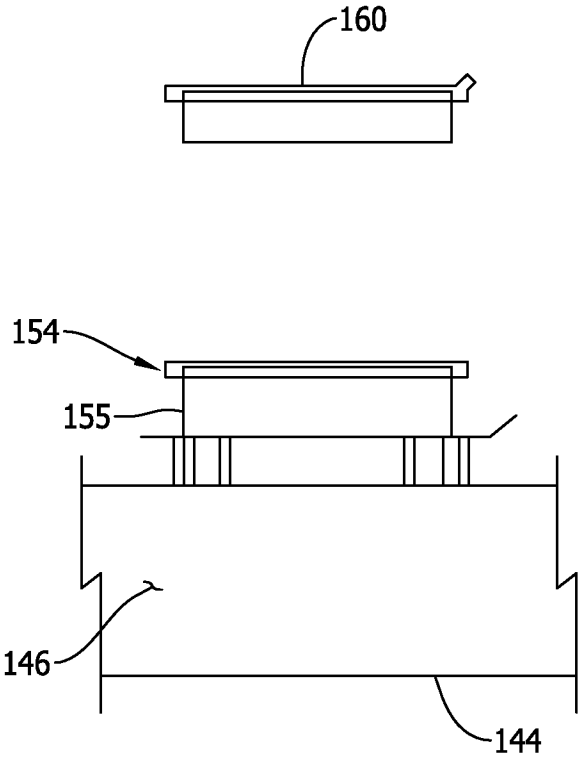
FIG. 7 is an enlarged sectional view of the access port shown in FIG. 6.

In reference to FIGS. 6 and 7, the access port 154 is sized and positioned to provide access to the interior space 146. For example, in some embodiments, liquid may be inserted into and removed from the interior space 146 through the access port 154. The access port 154 is circular and has a diameter 151. In some embodiments, the diameter 151 may be in a range of about 1 inch to about 5 inches. In this embodiment, the diameter 151 is about 3 inches. In other embodiments, the disposable container 108 may include any access port 154 that enables the disposable container 108 to function as described.

In the illustrated embodiment, the access port 154 is substantially centered relative to the width 174 of the disposable container 108. The access port 154 is positioned a longitudinal distance 175 from the lateral edge 186 of the first portion 148. In some embodiments, the longitudinal distance 175 may be in a range of about 1 inch to about 10 inches. In the illustrated embodiment, the longitudinal distance 175 is about 5.5 inches.

The access port may be selectively closed by a removable cap 160 to prevent liquid entering and exiting the interior space 146. The cap 160 removably connects to a collar 155 of the access port 154. In the illustrated embodiment, the collar 155 includes threads that engage threads of the cap 160 to enable the cap 160 to be screwed into the collar 155. In addition, the collar 155 is configured to engage one of the connectors 126 of the positioning device 110 (shown in FIG. 2). In particular, in the illustrated embodiment, the center connector 126 includes an engagement member that extends at least partially about the collar 155 to secure the disposable container 108 in position. In other embodiments, the access port 154 may include any collar that enables disposable container 108 to function as described. In some embodiments, the collar 155 is configured to receive a sanitary end-cap that is secured by a tri-clover clamp (not shown).

Figure 8:
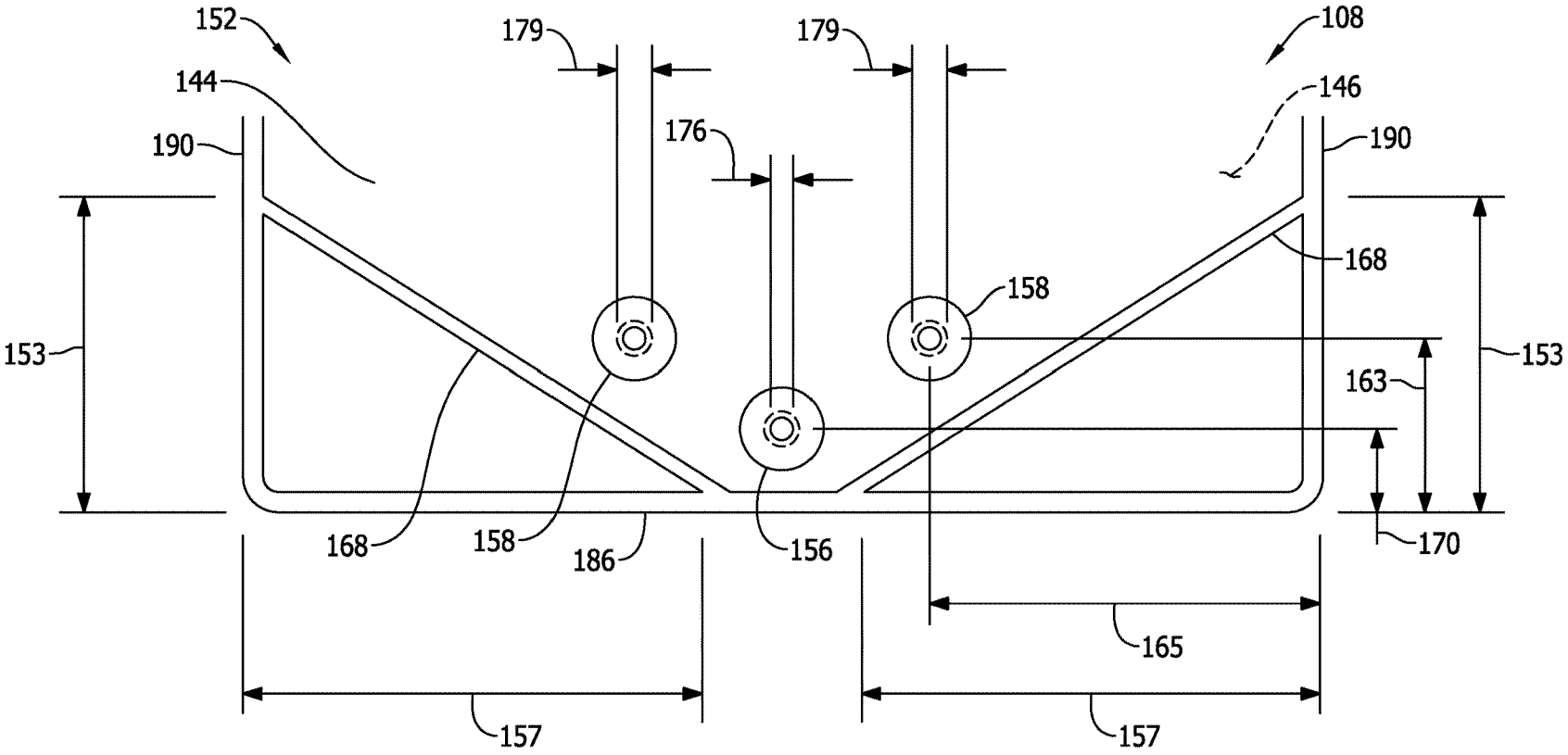
FIG. 8 is an enlarged view of a portion of the disposable container shown in FIG. 5 including a dispense port.

In reference to FIG. 8, the dispense port 156 is circular and has an inner diameter (ID) 176. The dispense port ID 176 may be in a range of about 0.25 inches to about 0.5 inch, and in this embodiment, the dispense port ID is about 0.25 inches. In other embodiments, the disposable container 108 may include any dispense port 156 that enables the disposable container 108 to function as described.

The dispense port 156 may be used to discharge liquid from the interior space 146. For example, the liquid may be discharged through dispense tubes 162 connected to the dispense port 156. At least one of the pumps 112 is configured to regulate flow of the liquid through the dispense tubes 162. In other embodiments, liquid may be dispensed from the dispense port 156 in any manner that enables the formulation apparatus 102 (shown in FIG. 2) to operate as described.

A clamp 164 may be connected to the dispense tubes 162 adjacent the dispense port 156 to restrict flow through the dispense tubes 162. Accordingly, the clamp 164 prevents liquids from being trapped in the dispense tubes 162 when liquid is not being directed through the dispense tubes 162 by the pumps 112. In some embodiments, the clamp 164 may be manipulated by an operator from the exterior of the radiation containment chamber 104 using devices such as telemanipulators.

Each circulation port 158 is circular and has a circulation port ID 179. The circulation port ID is suitably in a range of about 0.25 inches to about 0.5 inches, and in this embodiment, the circulation port ID is about 0.375 inches. In other embodiments, the disposable container 108 may include any dispense port 156 that enables the disposable container 108 to function as described.

The circulation ports 158 may be used to circulate or mix liquid within the interior space 146. For example, the liquid may be circulated through circulation tubes 166 connected to the circulation ports 158. In particular, the circulation tubes 166 may extend from a first circulation port 158 to a second circulation port 158. At least one of the pumps 112 (shown in FIG. 2) may cause liquid to flow through the circulation tubes 166 such that liquid is withdrawn from the interior space 146, flows through the circulation tubes 166, and is reinserted into a different area of the interior space 146. In other embodiments, the liquid may be circulated in any manner that enables the formulation apparatus 102 to operate as described. For example, in some embodiments, an agitator may be positioned within or on an exterior of the interior space 146 to circulate liquid within the interior space 146.

In this embodiment, the dispense tubes 162 and the circulation tubes 166 are constructed of plastic materials, such as polyurethane, polyethylene, polypropylene, polycarbonate, and silicone. Accordingly, the tubes 162, 166 are able to withstand the radioactive environment. In addition, the tubes 162, 166 are compatible with radioactive liquids within the disposable container 108. Also, the tubes 162, 166 are gamma sterilized and pyrogen-free, and prevent contamination of the radioactive liquids. In other embodiments, the formulation apparatus 102 may include any tube that enables the formulation apparatus 102 to operate as described.

In reference to FIG. 8, the second portion 152 of this embodiment is at least partially funnel-shaped and directs liquid towards dispense port 156 and circulation ports 158. In particular, angled seams 168 of disposable container 108 form a funnel shape of the second portion 152. Each angled seam 168 extends a longitudinal distance 153 from the lateral edge 186 and a lateral distance 157 from the longitudinal edge 190. In some embodiments, the longitudinal distance 153 is in a range of about 1 inch to about 20 inches. In further embodiments, the lateral distance 157 is in a range of about 1 inch to about 20 inches. In the illustrated embodiment, the longitudinal distance 153 is about 6.6 inches and the lateral distance 157 is about 10 inches. In other embodiments, the disposable container 108 may include any seam that enables the disposable container 108 to function as described.

In this embodiment, the dispense port 156 is positioned to enable substantially all of the liquid within the interior space 146 to be withdrawn through the dispense port 156. In particular, the dispense port 156 is centered relative to a transverse direction of disposable container 108 such that the angled seams 168 direct liquid towards the dispense port 156. In addition, the dispense port 156 is spaced a longitudinal distance 170 from the lateral edge 186 of the disposable container 108. In suitable embodiments, the longitudinal distance 170 is in a range from about 0.5 inches to about 2 inches. In the illustrated embodiment, the longitudinal distance 170 is approximately 1.4 inches. In other embodiments, the dispense port 156 may be positioned anywhere in the disposable container 108 that enables the disposable container 108 to function as described.

The circulation ports 158 of this embodiment are spaced a longitudinal distance 163 from a lateral edge 186 of the disposable container 108 and a lateral distance 165 from a longitudinal edge 190 of the disposable container 108. The longitudinal distance 163 is suitably in a range of about 0.5 inches to about 12.0 inches. In further embodiments, the lateral distance 165 is in a range of about 1.0 inches to about 20 inches. In the illustrated embodiment, the longitudinal distance 163 is about 3.4 inches and the lateral distance 165 is about 8.25 inches. In other embodiments, the circulation ports 158 may be positioned anywhere on the disposable container 108. In some embodiments, the circulation ports 158 may be omitted.

During operation, the positioning device 110 may move the disposable container 108 to facilitate accessing, dispensing, and/or treating the liquids within the disposable container 108. For example, the positioning device 110 may position the disposable container 108 such that the first portion 148 is positioned below the second portion 152. In particular, the first portion 148 may be positioned below the horizontal plane 136 (shown in FIG. 4) and the second portion 152 may be positioned above the horizontal plane 136 such that the disposable container 108 is positioned at a negative angle relative to the horizontal plane 136. Such positions may facilitate access to the interior space 146 through the access port 154.

In another example, the disposable container 108 may be positioned such that the second portion 152 is positioned below the first portion 148. In particular, the second portion 152 may be positioned below the horizontal plane 136 and the first portion 148 may be positioned above the horizontal plane 136. Accordingly, liquid within the interior space 146 may be directed towards the circulation ports 158 and the dispense port 156. In the illustrated embodiment, the dispense port 156 is positioned adjacent the longitudinal edge 190 of the second portion 152 to facilitate substantially all the liquid within the interior space 146 being discharged through the dispense port 156.

In reference to FIG. 4, the positioning device 110 may selectively position the disposable container 108 at specific angles relative to the horizontal plane 136 for specific formulation tasks. For example, the disposable container 108 may be positioned at approximately a −5° angle to facilitate removal of liquid through the access port 154. The disposable container 108 may be positioned at approximately a 30° angle to facilitate mixing liquid within interior space 146 and/or dispensing liquid. In addition, the disposable container 108 may be positioned at a 90° angle to facilitate dispensing substantially all the liquid from the interior space 146 through the dispense port 156 (shown in FIG. 5).

In reference FIGS. 2 and 4, in some embodiments, the formulation apparatus 102 may be used to mix the radioactive liquid. In particular, at least one of the pumps 112 may direct the liquid through the circulation tubes 166 until the liquid within the interior space 146 is substantially homogeneously mixed. The disposable container 108 may be positioned any at any angle during the mixing operation. For example, the disposable container 108 may be positioned at an approximately 30° angle with the horizontal plane 136. In such embodiments, approximately 25 liters of radioactive liquid within the disposable container 108 may be homogeneously mixed in approximately 3 minutes with the pump 112 operating at a rate of approximately 200 rotations per minute.

Also, in some embodiments, the formulation apparatus 102 may be used to dispense the radioactive liquid from the disposable container 108 after formulation. In particular, at least one of the pumps 112 may direct the liquid through the dispense tubes 162 until the desired amount of liquid has been dispensed. The disposable container 108 may be positioned any at any angle during the dispense operation. For example, the disposable container 108 may be positioned at an approximately 90° angle with the horizontal plane 136 such that liquid is directed towards the dispense port 156. The circulation tubes 166 may be raised to facilitate the liquid in the circulation tubes 166 flowing toward the dispense port 156 while the liquid is dispensed. Accordingly, substantially all liquid within the interior space 146 may be dispensed from the disposable container 108 in a relatively short time. For example, in some embodiments, a volume of about 500 milliliters of liquid can be drained from the disposable container 108 in approximately 45 seconds.

Figure 9:
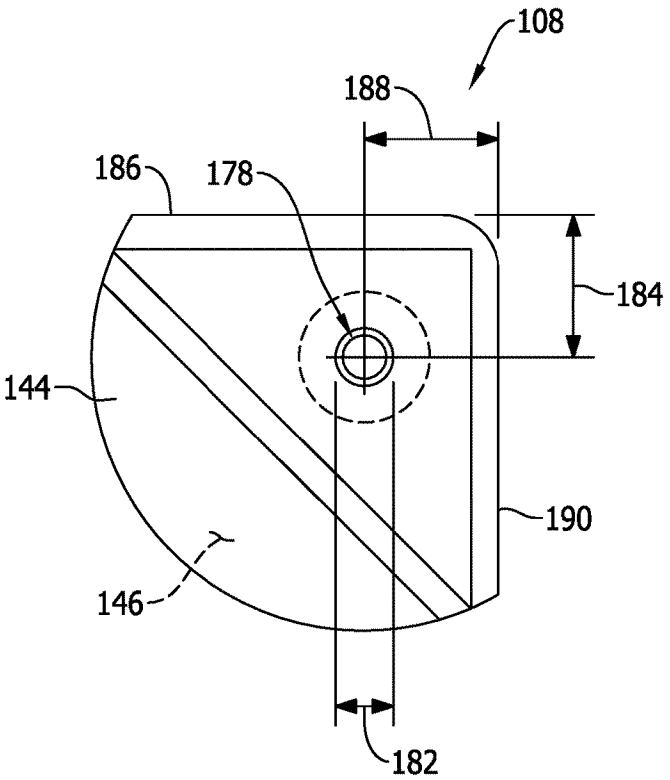
FIG. 9 is an enlarged view of a portion of the disposable container shown in FIG. 4 including an eyelet.

In reference to FIGS. 6 and 9, the disposable container 108 includes eyelets 178 to facilitate securing disposable container 108 on positioning device 110 (shown in FIG. 2). The eyelets 178 include openings in the flexible sidewall 144 that are lined by a supportive ring. Each eyelet 178 is configured to receive at least one of the connectors 126 of the positioning device 110. Accordingly, the disposable container may be suspended by the eyelets 178. The eyelets 178 are positioned in corners of the disposable container 108 and are sealed from the interior space 146 by angled seams 180. In the illustrated embodiment, the eyelets 178 are circular and have a diameter 182. In some embodiments, the diameter 182 is in a range of about 0.1 inches to about 2 inches. In the illustrated embodiment, the diameter 182 is about 0.5 inches. In other embodiments, the disposable container 108 may include any eyelet 178 that enables the disposable container 108 to function as described.

In the illustrated embodiment, the eyelets 178 are spaced a longitudinal distance 184 from a lateral edge 186 of the disposable container 108 and a lateral distance 188 from a longitudinal edge 190 of the disposable container 108. In some embodiments, the longitudinal distance 184 is in a range of about 0.5 inches to about 5 inches. In further embodiments, the lateral distance 188 is in a range of about 0.5 inches to about 5 inches. In the illustrated embodiment, the longitudinal distance 184 is about 1.4 inches and the lateral distance 188 is about 1.4 inches. In other embodiments, the eyelets 178 may be positioned anywhere on the disposable container 108. In some embodiments, the eyelets 178 may be omitted.

Also, in the illustrated embodiment, each angled seam 180 extends a longitudinal distance 189 from the lateral edge 186 and a lateral distance 191 from the longitudinal edge 190. In some embodiments, the longitudinal distance 189 is in a range of about 1 inch to about 10 inches. In further embodiments, the lateral distance 191 is in a range of about 1 inch to about 10 inches. In the illustrated embodiment, the longitudinal distance 189 is about 5 inches and the lateral distance 191 is about 5 inches. In other embodiments, the disposable container 108 may include any seam that enables disposable container 108 to function as described.

In reference to FIG. 3, during operation, the disposable container 108 may be positioned within the cavity 124 and secured to the table 114. In particular, the disposable container 108 may be secured to the table 114 by the connectors 126. In the illustrated embodiment, some of the connectors 126 extend through the eyelets 178 and at least one of the connectors 126 engages the collar 155 of the access port 154. During operation, sometimes the disposable container 108 may rest against the plate 120 of the table 114. At other times, the table 114 and the disposable container 108 may be positioned such that the disposable container 108 is at least partially spaced from the plate 120 and is suspended from the connectors 126. Accordingly, the connectors 126 facilitate the disposable container 108 being positioned and remaining secured to the table 114.

In reference to FIG. 1, the controller 106 includes at least one memory device 910 and a processor 915 that is coupled to the memory device 910 for executing instructions. In this embodiment, executable instructions are stored in the memory device 910, and the controller 106 performs one or more operations described herein by programming the processor 915. For example, the processor 915 may be programmed by encoding an operation as one or more executable instructions and by providing the executable instructions in the memory device 910.

The processor 915 may include one or more processing units (e.g., in a multi-core configuration). Further, the processor 915 may be implemented using one or more heterogeneous processor systems in which a main processor is present with secondary processors on a single chip. As another illustrative example, the processor 915 may be a symmetric multi-processor system containing multiple processors of the same type. Further, the processor 915 may be implemented using any suitable programmable circuit including one or more systems and microcontrollers, microprocessors, programmable logic controllers (PLCs), reduced instruction set circuits (RISC), application specific integrated circuits (ASIC), programmable logic circuits, field programmable gate arrays (FPGA), and any other circuit capable of executing the functions described herein. In this embodiment, the processor 915 controls operation of formulation apparatus 102 by outputting control signals to each of the positioning devices 110.

The memory device 910 is one or more devices that enable information such as executable instructions and/or other data to be stored and retrieved. The memory device 910 may include one or more computer readable media, such as, without limitation, dynamic random access memory (DRAM), static random access memory (SRAM), a solid state disk, and/or a hard disk. The memory device 910 may be configured to store, without limitation, application source code, application object code, source code portions of interest, object code portions of interest, configuration data, execution events and/or any other type of data.

In this embodiment, the controller 106 includes a presentation interface 920 that is connected to the processor 915. The presentation interface 920 presents information, such as application source code and/or execution events, to a user 925, such as a technician or operator. For example, the presentation interface 920 may include a display adapter (not shown) that may be coupled to a display device, such as a cathode ray tube (CRT), a liquid crystal display (LCD), an organic LED (OLED) display, and/or an "electronic ink" display. The presentation interface 920 may include one or more display devices. In this embodiment, the presentation interface 920 displays a graphical user interface for receiving information from the user 925, such as a target dispense or transfer volume.

The controller 106 also includes a user input interface 930 in this embodiment. The user input interface 930 is connected to the processor 915 and receives input from the user 925. The user input interface 930 may include, for example, a keyboard, a pointing device, a mouse, a stylus, a touch sensitive panel (e.g., a touch pad or a touch screen), a gyroscope, an accelerometer, a position detector, and/or an audio user input interface. A single component, such as a touch screen, may function as both a display device of the presentation interface 920 and the user input interface 930. In this embodiment, the user input interface 930 receives an input associated with a position of the disposable container 108 including, for example and without limitation, an angle measure.

In this embodiment, the controller 106 further includes a communication interface 935 connected to the processor 915. The communication interface 935 communicates with one or more remote devices, such as the formulation apparatus 102.

The controller 106 exchanges signals with the formulation apparatus 102 to control the formulation apparatus 102 during formulation of the radioactive liquid. In particular, the controller 106 may control the positioning device 110 to position the disposable container 108 at desired positions that facilitate at least one operation of the formulation apparatus 102. For example, the controller 106 may control the positioning device 110 such that the disposable container 108 is positioned to direct radioactive liquid towards the dispense port 156 (shown in FIG. 5) when radioactive liquid is being dispensed from the disposable container 108. In some embodiments, the controller 106 may control the formulation apparatus 102 based at least in part on user inputs. In further embodiments, the system 100 may be at least partially automated. For example, the disposable container 108 may be automatically positioned at a desired position for a specific operation of the formulation apparatus 102.

Embodiments of the systems and methods described provide several advantages over known systems. In particular, embodiments of the systems and methods provide a disposable container for use during formulation of radioactive liquids without need for cleaning validation or revalidation. For example, embodiments of the systems and methods described provide a disposable, shatter-proof, container including a flexible sidewall that is made of sterile, pyrogen-free materials and is compatible with radioactive materials. The disposable container provides several advantages over known containers, such as reusable vessels. For example, the disposable containers can be positioned in multiple positions during formulations. Also, the disposable containers can be disposed after use into solid waste without spilling liquid or contaminating hot cells. The containers do not require cleaning, validation, and/or storage in long-term radiation shielding storage, and typically have a 3 year shelf-life after gamma sterilization. The disposable containers provide increased visibility of contents of the disposable container because the disposable containers remain substantially transparent and do not darken in a single use, in contrast to materials such as glass which darken to near opaque translucence during use. In addition, the disposable containers prevent contamination because the disposable containers are almost fully sealed and inhibit most contamination from entering the container. Further, the disposable containers cannot shatter during use. In addition, the disposable containers do not contribute to personnel whole body or extremity exposure during processing or clean-up, and thus reduce operator exposure to radiation.

Embodiments of the formulation apparatus described provide positioning systems that accurately position the disposable container during formulation. The positioning system provides for precise positioning of the disposable container. For example, the positioning system positions the disposable container at an angle relative to a horizontal plane. In particular, an actuator of the positioning system is configured to rotate the disposable container through a broad range of angles. In addition, embodiments of the formulation apparatus described herein reduce contamination of the radioactive material during operation and reduce operator exposure to radiation. Further, the positioning system allows a disposable container to be lowered to remove pressure if the disposable container is punctured during use. In addition, the contents of the punctured disposable container may be pumped into another disposable container so that formulation activities can continue.

When introducing elements of the present invention or the embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A disposable container for use in formulating a radioactive liquid, the container including:

a flexible sidewall defining an interior space for containing the radioactive liquid during formulation, the flexible sidewall being constructed of sterile, pyrogen-free material to prevent contamination of the radioactive liquid, the flexible sidewall including a first portion and a second portion;

an access port defined by the first portion of the flexible sidewall to provide access to the interior space;

a dispense port defined by the second portion of the flexible sidewall for the radioactive liquid within the interior space to be dispensed through; and circulation ports defined by the flexible sidewall and connectable to a circulation tube to allow circulation of the radioactive liquid within the interior space.

2. The disposable container of claim 1, wherein the second portion is at least partially funnel-shaped to direct the radioactive liquid towards the dispense port.

3. The disposable container of claim 2 further comprising angled seams that form the funnel shape.

4. The disposable container of claim 1 further comprising a cap to close the access port.

5. The disposable container of claim 1, wherein the circulation ports are defined by the second portion of the flexible sidewall.

6. The disposable container of claim 1, wherein the first portion is configured to receive connectors, the disposable container arranged to be suspended from the connectors such that the first portion is above the second portion.

7. The disposable container of claim 1 further comprising eyelets for securing the disposable container to a positioning device, wherein the sidewall is sealed adjacent the eyelets to prevent the radioactive liquid from exiting the interior space through the eyelets.

8. A system for formulating a radioactive liquid, the system comprising:

a nuclear radiation containment chamber including an enclosure constructed of a nuclear radiation shielding material;

a disposable container including a flexible sidewall, the flexible sidewall defining an interior space for containing the radioactive liquid during formulation;

a positioning device positioned within an interior of the enclosure, the positioning device including:

a support configured to support the disposable container on the positioning device; and an actuator operatively connected to the support and configured to rotate the support, the actuator including a motor; and a dispense pump connected to the disposable container in fluid communication with the interior space to dispense the radioactive liquid from the interior space.

9. The system of claim 8 further comprising a circulation pump connected to the disposable container for circulating the radioactive liquid.

10. The system of claim 8, wherein the flexible sidewall includes a first portion and a second portion, the disposable container including an access port defined by the first portion, a dispense port defined by the second portion, and circulation ports defined by the second portion.

11. The system of claim 8 further comprising a controller and an interface connected to the actuator to control the position of the disposable container.

12. The system of claim 11, wherein the controller is configured to rotate the disposable container such that liquid flows towards a dispense port when the dispense pump dispenses the radioactive liquid.

13. The system of claim 8, wherein the support comprises a table, the disposable container being connected to the table by fasteners extending through a first portion of the flexible sidewall.

14. The system of claim 8 further comprising tubes extending between the disposable container and the dispense pump.

15. A method of formulating radioactive liquid contained within a disposable container, the method comprising:

connecting the disposable container to a positioning device;

rotating an actuator of the positioning device to position the disposable container in a first position, the actuator including a motor;

formulating the radioactive liquid within an interior space of the disposable container while the disposable container is in the first position;

rotating the actuator of the positioning device to position the disposable container in a second position; and dispensing the liquid from the disposable container using a dispense pump, wherein the radioactive liquid is directed towards a dispense port of the disposable container when the disposable container is in the second position.

16. The method of claim 15 further comprising opening an access port of the disposable container to access the interior space while the disposable container is in the first position.

17. The method of claim 15 further comprising circulating the radioactive liquid using a circulation pump in fluid communication with the disposable container.

18. The method of claim 15, wherein formulating the radioactive liquid includes diluting the liquid, the method further comprising extracting a sample of the liquid, adjusting a pH of the liquid, and homogeneously mixing the liquid.

19. The method of claim 15, wherein rotating an actuator of the positioning device to position the disposable container in a first position comprises positioning the disposable container at an angle relative to a horizontal plane.

20. The method of claim 19, wherein the angle is in a range of about −5 degrees to about 90 degrees.

* * * * *